US005947713A

United States Patent [19]

Öhman et al.

[11] Patent Number: 5,947,713

[45] Date of Patent: Sep. 7, 1999

[54] PAIR OF CO-OPERATING SCREW ROTORS, A SCREW ROTOR AND A ROTARY SCREW MACHINE

[75] Inventors: Henrik Öhman, Täby Kyrkby; Erik Thuresson, Älta, both of Sweden

[73] Assignee: Svenska Rotor Maskiner AB, Stockholm, Sweden

[21] Appl. No.: 08/851,087

[22] Filed: May 5, 1997

[30] Foreign Application Priority Data

Dec. 16, 1996 [SE] Sweden ..... 9604618

[51] Int. Cl.[6] ..... F01C 1/16

[52] U.S. Cl. ..... 418/201.3

[58] Field of Search ..... 418/201.3

[56] References Cited

U.S. PATENT DOCUMENTS

| | | | |
|---|---|---|---|
| 4,508,496 | 4/1985 | Bowman | 418/201.3 |
| 4,527,967 | 7/1985 | Ingalls | 418/201.3 |
| 4,679,996 | 7/1987 | Tanaka et al. | 418/201.3 |

*Primary Examiner*—John J. Vrablik

*Attorney, Agent, or Firm*—Frishauf, HOltz, Goodman, Langer & Chick, P.C.

[57] ABSTRACT

A pair of co-operating screw rotors include a male rotor and a female rotor each having helically extending lobes and intermediate grooves which intermesh. The male rotor has an external radius $R_M$ and a pitch radius $R_{MP}$ defining a pitch circle $C_{MP}$, and each lobe of the male rotor in a predetermined section has a leading lobe flank and a trailing lobe flank which are substantially convex. The predetermined section is perpendicular to an axis $O_M$ of the male rotor and an axis $O_F$ of the female rotor, and each lobe of the female rotor in the predetermined section has a leading lobe flank and a trailing lobe flank which are substantially concave. Each lobe of the male rotor and each lobe of the female rotor has an asymmetric profile in the predetermined section. Each of the leading flank and the trailing flank of at least one of the male rotor lobes has a male circular arc segment having a center of curvature $A_{1M}$, $A_{2M}$ and a radius of curvature $R_1$, $R_2$. The center of curvature $A_{1M}$, $A_{2M}$ is on the pitch circle $C_{MP}$, and the radius of curvature $R_1$, $R_2$ deviates from a difference between the external radius $R_M$ of the male rotor and the pitch radius $R_{MP}$ of the male rotor. Each of the leading flank and trailing flank of at least one of the female rotor lobes has a female circular arc segment having a center of curvature $A_{1F}$, $A_{2F}$ and the same radius of curvature $R_1$, $R_2$ as the male circular arc segment. The female circular arc segments cooperate with the male circular arc segments at a moment of contact therebetween.

28 Claims, 4 Drawing Sheets

PAIR OF CO-OPERATING SCREW ROTORS, A SCREW ROTOR AND A ROTARY SCREW MACHINE

BACKGROUND OF THE INVENTION

The present invention relates to a pair of co-operating screw rotors, to a screw rotor, and to a rotary screw machine. Each rotor has helically extending lobes and intermediate grooves, through which the rotors intermesh, one rotor is a male rotor with each lobe in a section perpendicular to the rotor axes having a leading lobe flank and a trailing lobe flank, both being substantially convex. The other rotor is a female rotor with each lobe in said section having a leading and a trailing lobe flank, both being substantially concave. Each lobe of the male and female rotor has an asymmetric profile in said section.

In a rotary screw machine of the kind for which the rotors of the invention are intended, a compressible medium is compressed or expanded by intermeshing two rotors in a working space sealingly surrounding the pair of rotors which has the shape of two intersecting circular cylinders.

Decisive to the function and the efficiency of such a machine is the shape of its rotors, more precisely the shape of the flanks of the rotor lobes.

Normally, in a rotary screw compressor at work only one of the rotors is driving and transmits torque to the other one, the driven rotor. Usually a liquid is injected such as oil or water into the working space of the machine, which liquid forms a film on the flanks of the lobes for lubricating, cooling and sealing purposes. The lobes co-operate by intermeshing and are shaped to transmit torque between the rotors and to seal working chambers in the working space of the machine. An important aspect when designing the profiles of the lobes therefore is to attain a contact band between the rotors that in this respect is optimal. The contact band should be of sufficient size for the contact pressure which the material and the liquid film are exposed to. The contact band should have limits so defined that a minor error during manufacture such as pitch error, a wrong distance between the centres or a large deflection of the rotor does not have the consequence that the contact band will be materially displaced, which would lead to a risk for increased friction losses and breakdown. The shape of the profile should also be such that it allows the liquid to a high degree to gather on the surfaces of the contact band during periods when they are not in contact. The profile should in the areas neighbouring the contact band on both sides have a profile that does not move liquid from the surfaces of the contact band just before contact. Furthermore, the contact band should be well defined for measurement and control.

When designing the rotor profiles one has to take the total length of the contact band or the sealing line into consideration as well as other general aspects such as the size of the blow-hole, the contact forces, the volumetric capacity, thermal expansion, generation of vibrations and demands relating to the manufacture. There are also some mathematical limitations for the profiles. For some compressors, certain aspects are more important than others and for other compressors there might be reasons to give priority to other aspects. An optimal profile usually represents a compromise between different requirements related to these aspects, the compromise being dependent on which of these are the most important in the actual case.

Due to the decisive importance of the shape of the rotor profiles in a rotary screw machine and due to the complex weightening between the aspects that have to be considered there are a large number of granted patents focusing on the profiles, all since Lysholm during the thirties presented and got a patent for the first rotary screw compressor of this kind that could be used in practice.

There are many ways in patent literature in which the rotor profiles are defined, depending on which problem(s) the patent relates to and due to the complicated shape of these profiles. The profiles are thus defined as a family of characteristics, a combination of such, by some important parameters, by ranges for certain features of the profile, by expressions implicitly defining the profile or in another way. Furthermore the profiles can be divided into different categories according to various criteria such as symmetric or asymmetric profiles or such as circular, point generated or travelling-point generated.

The present invention primarily is related to attain a profile with an optimal design of the contact band taking those of the above requirements into consideration that should be relevant for that.

A principal problem to be solved is that the width of the contact band has to be limited since a minor error in manufacture otherwise would displace the contact band to areas where the relative speed between the contact surfaces is large and the allowable surface pressure of the material is exceeded. This would mean a decreased efficiency and a risk for break-down due to surface rupture in the material.

Since furthermore the extension of the contact band is substantially longitudinal and the end positions in the plane are very hard to define in practice there will be great difficulties to measure and evaluate the manufactured rotor. This means high costs for measuring the profiles.

Furthermore the gradual change in the plane and along the contact band from non-contact to contact results in that the neighbouring surfaces remove the liquid layer from these surfaces that later enter into the contact band. This means less effective lubrication resulting in wear and vibrations.

These problems entail all point generated and travelling-point generated profiles except the symmetric profiles. A symmetric profile however suffers from other drawbacks such as bad efficiency etc.

When the mentioned problem have occurred one usually has taken various measures to solve them. When the material stress has been too high it is possible to use harder or hardened material, which is expensive. It has also been developed profiles with smaller transmitted torque and larger travelling-point generated contact bands. This has increased the risk for vibrations since the contact sometimes is lost due to torque pulses. In addition one faces the risk of contact on profile portions where contact is undesired due to manufacturing error or rotor deflection.

Through European patent No. 149 304 it is earlier known a pair of rotors of the kind in question where one has tried to attain an improved shape of the rotor lobe flank profiles, whereby in particular the shape of the contact band has been focused on. Thus it is disclosed a contact band formed by a concave circular arc on the leading female rotor flank and a complementary convex circular arc on the trailing male rotor flank co-operating therewith. This construction of the profile has the disadvantage that it can be used only for female drive compressors. Furthermore, the circular arcs according to this construction have the centre defined to the rolling point, i.e. the rolling angle into contact=0.

The object of the present invention is in this context to attain rotors with lobe profiles that solve the problems mentioned above without having the drawbacks entailing previous attempts to attain this.

SUMMARY OF THE INVENTION

According to the invention this has been achieved in that a pair of co-operating screw rotors of the kind specified in the introduction above is characterized in that at least one of the flanks of a male rotor lobe has a circular arc segment, which at least at each end of the segment has the shape of a circular arc, each said circular arc shaped portion of the segment having equal radius and coinciding centre of curvature, which radius deviates from the difference between the external radius and the pitch radius of the male rotor and that the female rotor lobe flank co-operating with said one flank has a flank segment co-operating with said flank segment of the male rotor lobe, by a screw rotor of male or female type shaped to be able to form one of the rotors in a pair of co-operating screw rotors according to the invention, and in that a rotary screw machine is provided with a pair of co-operating rotors according to the invention.

Thanks to the fact that the contact band is formed by the two co-operating circular arc flank segments under the specified conditions a momentary developed contact surface in the plane is attained between the two rotors. The projection of the contact band in a plane will be easy to conceive and measure. The end points will be clearly defined and clearance can be provided to the very end points without the risk for one-point contact at one of the end points. Furthermore the sensitivity for manufacturing errors is decreased since the end points are easily worn down to the contact arcs. The profile will adapt by wear without the risk for excessive stress. This means less severe demands for tolerances and cheaper manufacture. The concave surface will also serve as a collecting groove for the liquid that by gravitation is moved along the surfaces of the rotors. Thereby the lubrication of the contact is improved and a lower level of vibration is attained. This is also promoted by the possibility to allow clearance all the way to the end points of the contact band so that the phenomena, that non-contacting surfaces remove the liquid film from those surfaces that are to go into contact, not will occur. Since, in addition, the risk of undesired extension of the contact surfaces is reduced, a maximal surface can be used for torque transfer between the rotors. In this way the surface stressed in the rotor material is minimized.

As a result of these advantages less viscous liquids than oil can be used as lubricant. Water will be excellent to use when compressing air from 1 bar to 8 bars with this profile, resulting in an environment friendly and highly efficient compression.

Through the fact that the rolling angle to contact will be more than 0 as consequence of the defined conditions for the radius of curvature, the limitations related to the above mentioned European patent No. 149 304 are eliminated and it will be possible to adapt the radius, the angle of the segment and the contact force to the actual circumstances in dependence of lubricant, torque and other operation conditions.

In a preferred embodiment of the invention the co-operating flank segment of the female rotor lobe flank at least at its end has circular arc shape, which will create the best conditions for a good co-operation with the corresponding segment of the male rotor lobe. Thereby the radii of the two segments should preferably be equal, which leads to an optimal utilisation of the advantages of the invention, since in that case the surfaces would be as adapted to each other as possible.

According to a preferred embodiment, the special flank segment is provided on the leading flank of the male rotor lobe, whereby the advantages of the invention can be utilised for male-drive, which is of great importance. In such an embodiment the radius of the segment has to be less than the difference between the male rotor external radius and its pitch radius. It has been found to be advantageous that the radius should be in the range of 0.2 to 0.9, preferably 0.65 to 0.70 times said difference in radius.

Alternatively the flank segment can be provided on the trailing flank of the male rotor lobe so that the rotors will be appropriate for female-drive. The radius of the segment thereby will be larger than the difference in radius mentioned above. Suitably the range is 1.1 to 2.0, preferably 1.30 to 1.35 times said difference in radius.

The invention can be advantageously applied for a travelling-point generated profile, i.e. a profile where the curve of the profile at least on one or more certain portions is generated by a point on the lobe flank on the other rotor when this rotates, whereby said point simultaneously continuously moves along the lobe flank of the second rotor.

The above mentioned and other advantageous embodiments of the invention are specified in the dependent claims.

BRIEF DESCRIPTION OF THE DRAWINGS

The invention will be further explained through the following detailed description of preferred embodiments thereof and with reference to the accompanying drawings, in which.

DETAILED DESCRIPTION

Figure 1:
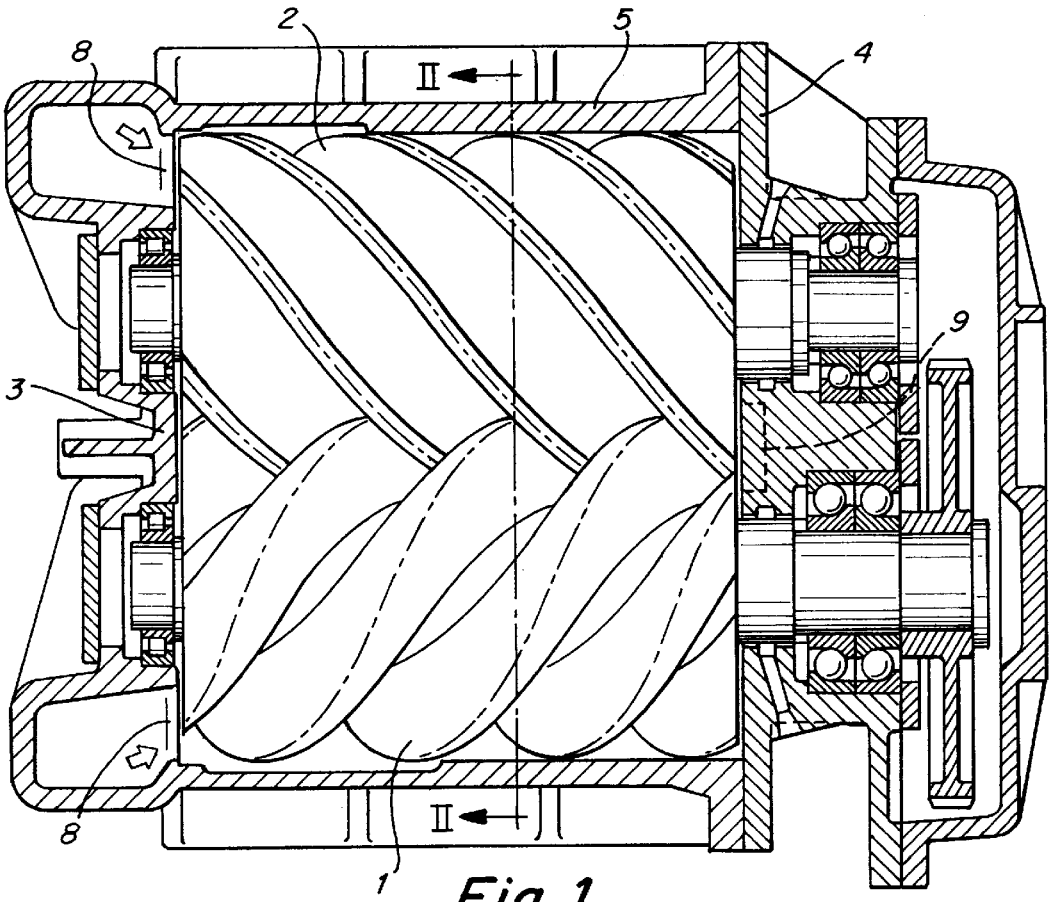
Fig. 1 PRIOR ART
FIGS. 1–3 illustrate a rotary screw compressor according to generally known technique, and the function principle is explained in relation thereto.
Figure 2:
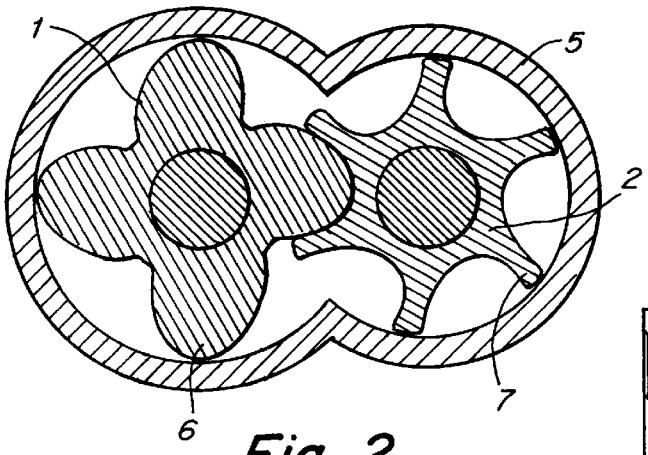
Fig. 2 PRIOR ART

The compressor includes a pair of meshing screw rotors 1, 2 operating in a working space limited by two end walls 3, 4 and a barrel wall 5 extending between these, which barrel wall 5 has an internal shape substantially corresponding to that of two intersecting cylinders as can be see in FIG. 2. Each rotor 1, 2 has a plurality of lobes 6, 7 respectively, and intermediate grooves extending helically along the entire rotor. One rotor 1 is of the male rotor type with the major part of each lobe located outside the pitch circle and the other rotor is of the female rotor type with the major part of each lobe located inside the pitch circle. The female rotor normally has more lobes than the male rotor 1, and a common lobe combination is 4+6. Low pressure air (or gas) is admitted into the working space of the compressor through an inlet port 8, is then compressed in the chevron-shaped working chambers formed between the rotors and the walls of the working space. Each chamber travels to the right in FIG. 1 as the rotors rotate, and the volume of a working chamber will continuously decrease during the later stage of its cycle after communication with the inlet port 8 has been cut off. Thereby the air will be compressed, and the compressed air leaves the compressor through an outlet port 9. The internal pressure ratio will be determined by the internal volume ration, i.e. the relation between the volume of a working chamber immediately after its communication with the inlet port 8 has been cut off and the volume of a working chamber when it starts to communicate with the outlet port 9.

Figure 3:
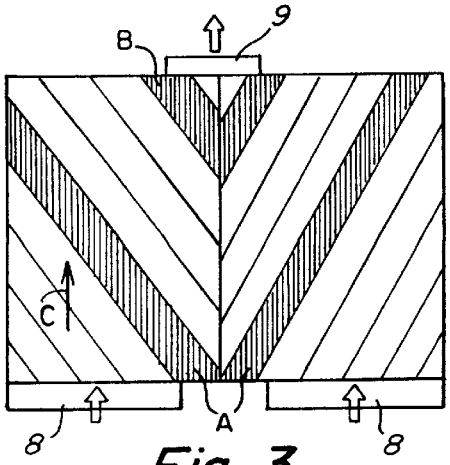
Fig. 3 PRIOR ART

The compression cycle is schematically illustrated in FIG. 3, which shows the barrel wall developed in a plane, the vertical lines representing the two cusps, i.e. the lines along which the cylinders forming the working space intersect. The inclined lines represent the sealing lines established between the lobe tops and the barrel wall, which lines travel in the direction of the arrow C as the rotors rotate. The shaded area A represents a working chamber just after it has been cut off from the inlet port 8 and the shaded area B a working chamber that has started to open towards the outlet port 9. As can be seen the volume of each chamber increases during the filling phase when the chamber communicates with the inlet port 8 and thereafter decreases.

Figure 4:
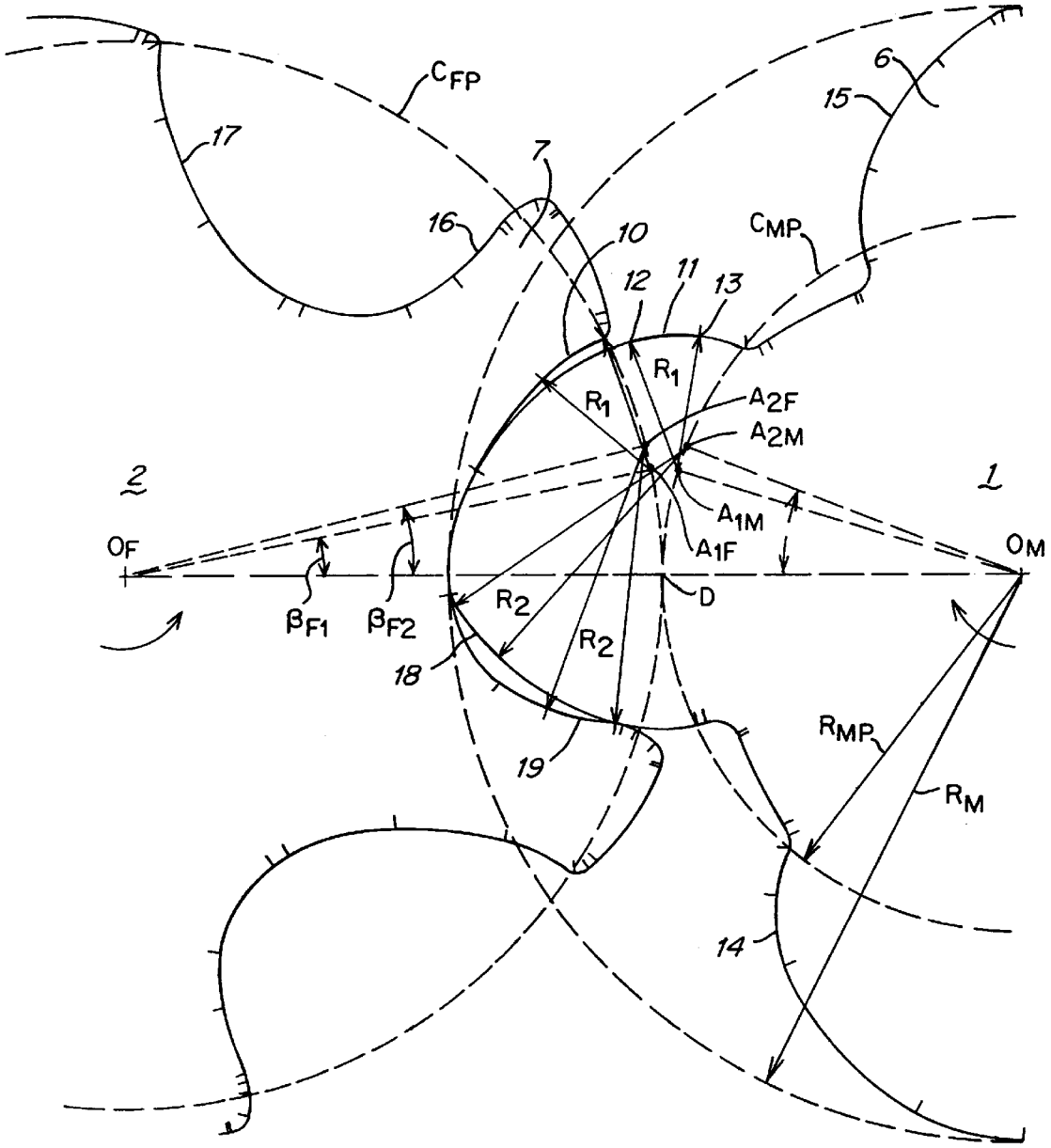
FIG. 4 shows a part of co-operating rotor lobes in a section perpendicular to the axes of the rotors according to an embodiment of the invention.

In FIG. 4 a pair of screw rotors according to an embodiment of the invention is shown. The rotors rotate as indicated by the arrows, the male rotor being the driving rotor. The external radius of the male rotor has the reference $R_M$ and its pitch radius $R_{MP}$. The leading flank of the male rotor lobe 6 has reference 14 and its trailing flank 15, the leading flank of the female rotor 7 has reference 16 and its trailing flank 17. The leading flank 14 of the male rotor lobe 6 has a profile segment 11 extending between the points 12 and 13 and is a circular arc. On the trailing flank 17 of the female rotor lobe 7 there is a corresponding circular arc flank segment 10 co-operating with the circular arc flank segment 11 of the male rotor lobe 6 so that a contact band is created through which torque is transmitted from the male rotor 1 to the female rotor 2.

The circular arc 11 of the leading flank 14 of the male rotor lobe 6 has its centre $A_{1M}$ on the pitch circle $C_{MP}$ of the male rotor and a radius $R_1$ that is smaller than the difference between the external radius $R_M$ of the male rotor and its pitch radius $R_{MP}$. $R_1$ is in the range from 0.2 to 0.9 times the difference $R_M-R_{MP}$. $R_1$ in the shown example is about ⅔ of $R_M-R_{MP}$. The corresponding circular arc 10 on the trailing flank of the female rotor lobe has its centre on the pitch circle $C_{FP}$ of the female rotor and a radius $R_1$ that is equal to that of the circular arc 11. Each of the circular arcs has an extension of about 0.2 to 0.8 radians, and preferably ½ radian.

In the shown example the male rotor lobe 6 is provided with a circular arc segment 18 also on its trailing flank 15. It has its centre on the male rotor pitch diameter $C_{MP}$ and a radius $R_2$ that is larger than the difference between $R_M$ and $R_{MP}$, in the range from 1.1 to 2.0 times the difference, or more precisely ⅓ of $R_M-R_{MP}$. $R_2$ thus is about twice as large as $R_1$. The corresponding circular arc 19 on the leading flank 16 of the female rotor lobe 7 has its centre on the female rotor pitch diameter $C_{FP}$ and the same radius $R_2$ as the circular arc 18. Each of the circular arcs 18, 19 has an extension of about 0.1 to 0.4, and preferably ¼ radian. Since $R_2$ is about twice as big as $R_1$, the circular arcs 18 and 19 are about the same length as the circular arcs 10 and 11. The ratio between the radius $R_2$ and the radius $R_1$ is in the range from 1.3 to 5.

The pair of rotors thus is provided with circular segments according to the invention on both the flanks of each lobe. The rotational direction indicated by arrows represents male rotor drive, whereby the torque is transferred from the male rotor to the female rotor through the contact band formed by the circular segments 10 and 11, when they have been turned into mesh, a position which in the illustrated case occurred $\beta_{F1}°$ before the position in FIG. 4. This meshing position is illustrated in FIG. 5

Figure 6:
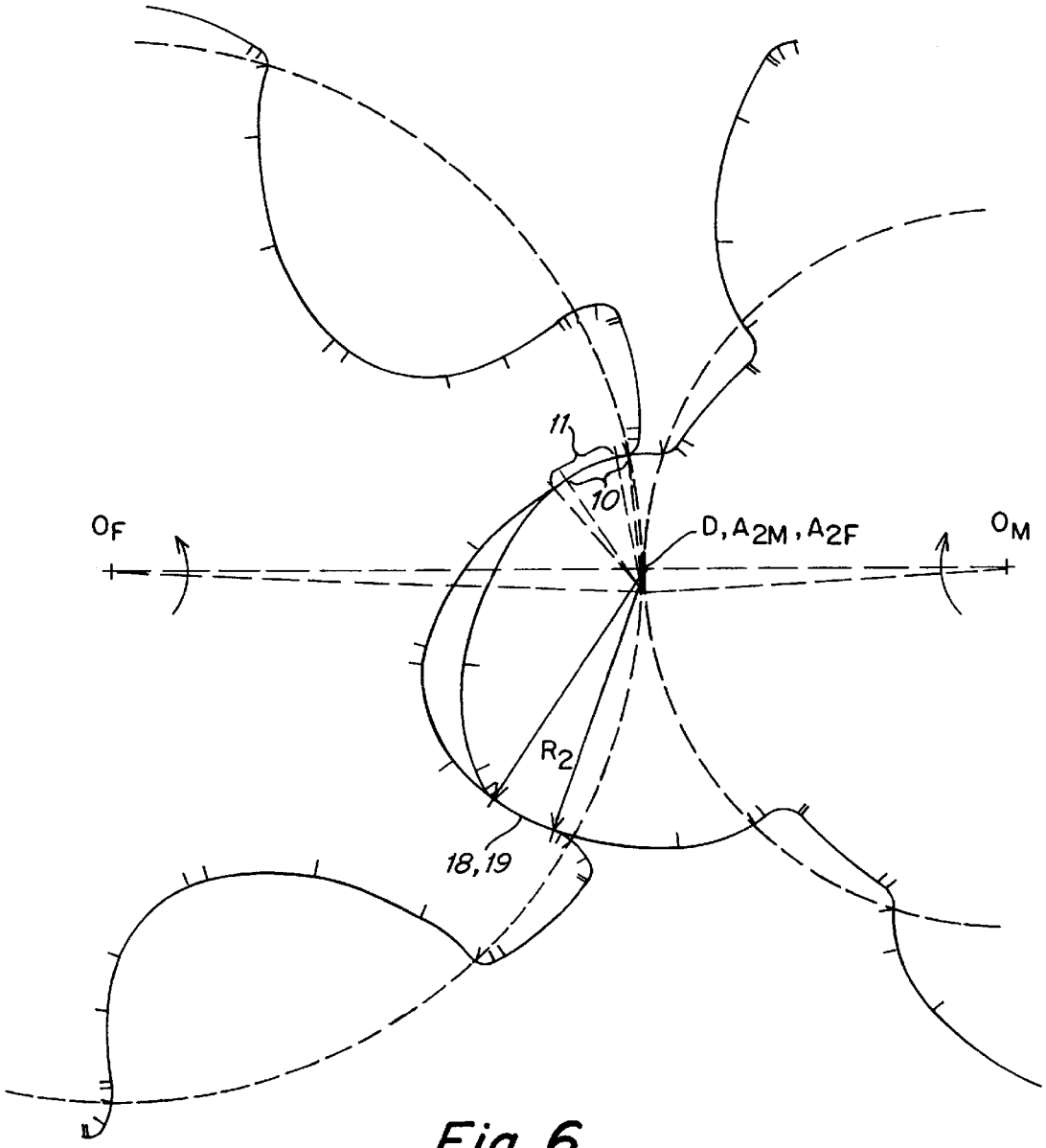
FIG. 6 is a section corresponding to FIG. 4 but showing the rotors in a third angular position.

At female drive the rotational direction is the same as the one indicated in FIG. 4, whereby torque is transferred from the female rotor to the male rotor when they have been turned into mesh, a position which in the case illustrated in FIG. 6 occurs $\beta_{F2}°$ before the position in FIG. 4. This mesh position is illustrated in FIG. 6.

Figure 5:
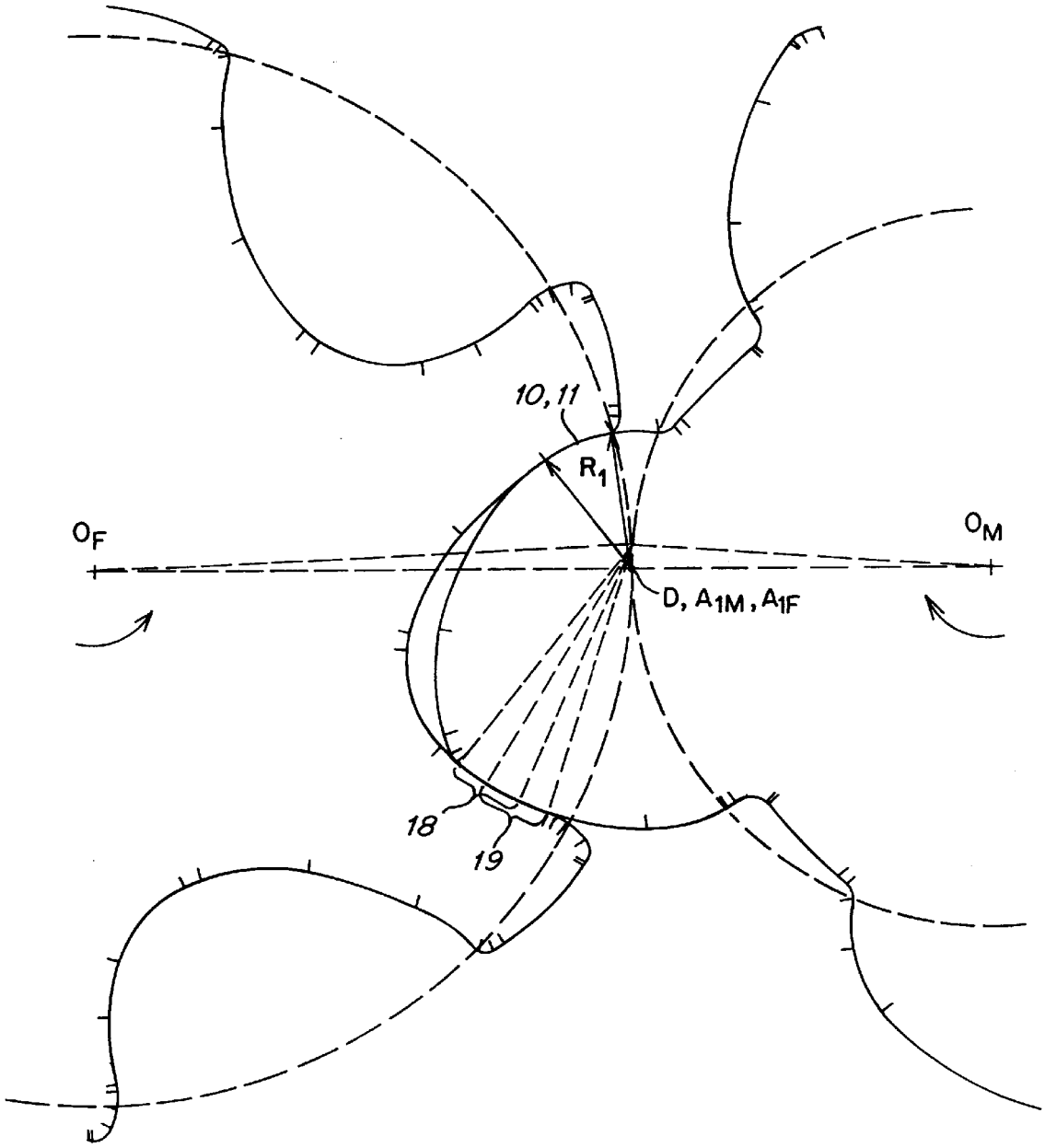
FIG. 5 is a section corresponding to FIG. 4, but showing the rotors in another angular position.

In FIG. 5 the mesh position, when the circular arc segments 10, 11 contact each other, is shown for male drive. Both the centres $A_{1M}$ and $A_{1F}$ of the circular segments coincide in the rolling point D.

In FIG. 6 in a corresponding way the mesh position, when the circular segments 18, 19 contact each other at female drive, is shown. Both the centres $A_{2M}$ and $A_{2F}$ of the circular segments coincide in the rolling point D.

Figure 7:
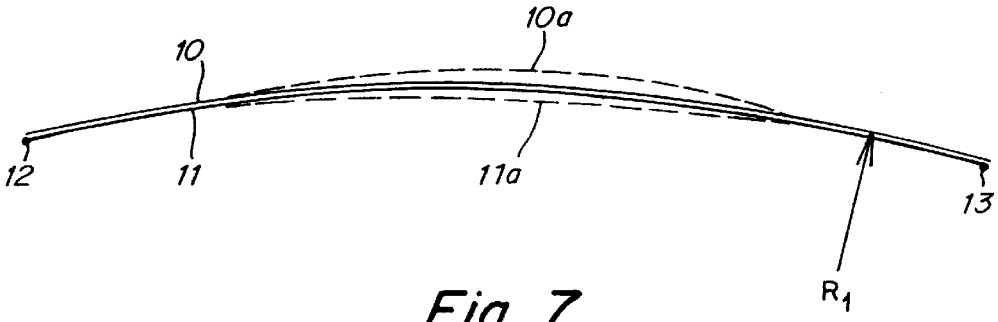
FIG. 7 is an enlargement of a detail of FIG. 5.

In FIG. 7 the flank segments 10 and 11 are shown enlarged when co-operating with each other. With unbroken lines an embodiment is depitched where both flank segments 10, 11 are continuous circular arcs of equal radius. Alternatively each or both flank segments can be "grooved" in the mid region such as by a recess 10*a* on the segment 10 or by a planning off 11*a* of the segment 11.

We claim:

1. A pair of co-operating screw rotors, comprising:

a male rotor having helically extending lobes and intermediate grooves; and a female rotor having helically extending lobes and intermediate grooves which intermesh with the helically extending lobes and intermediate grooves of said male rotor;

wherein said male rotor has an external radius $R_M$ and a pitch radius $R_{MP}$ defining a pitch circle $C_{MP}$;

wherein each lobe of the male rotor in a predetermined section has a leading lobe flank and a trailing lobe flank which are substantially convex, said predetermined section being perpendicular to an axis $O_M$ of the male rotor and an axis $O_F$ of the female rotor;

wherein each lobe of the female rotor in said predetermined section has a leading lobe flank and a trailing lobe flank which are substantially concave;

wherein each lobe of the male rotor and each lobe of the female rotor has an asymmetric profile in said predetermined section;

wherein each of the leading flank and the trailing flank of at least one of the male rotor lobes has a male circular arc segment having a center of curvature $A_{1M}$, $A_{2M}$ and a radius of curvature $R_1$, $R_2$, said center of curvature $A_{1M}$, $A_{2M}$ being on the pitch circle $C_{MP}$, and said radius of curvature $R_1$, $R_2$ deviating from a difference between the external radius $R_M$ of the male rotor and the pitch radius $R_{MP}$ of the male rotor;

wherein each of the leading flank and the trailing flank of at least one of the female rotor lobes has a female circular arc segment having a center of curvature $A_{1F}$, $A_{2F}$ and the same radius of curvature $R_1$, $R_2$ as the male circular arc segment;

wherein said female circular arc segments cooperate with said male circular arc segments at a moment of contact therebetween; and wherein the radius of curvature $R_1$ of the leading flank of the male rotor lobe is in a range from 0.2 to 0.9 times the difference in radius between the external radius $R_M$ of the male rotor and the pitch radius $R_{MP}$ of the male rotor, and the radius of curvature $R_2$ of the trailing flank of the male rotor lobe is in a range from 1.1 to 2.0 times the difference in radius between the external radius $R_M$ of the male rotor and the pitch radius $R_{MP}$ of the male rotor.

2. A pair of co-operating screw rotors according to claim 1, wherein a ratio between the radius of curvature $R_2$ of the male circular arc segment of the trailing flank of the male rotor lobe and the radius of curvature $R_1$ of the male circular arc segment of the leading flank of the male rotor lobe is in a range from 1.3 to 5.

3. A pair of co-operating screw rotors, comprising:

a male rotor having helically extending lobes and intermediate grooves; and a female rotor having helically extending lobes and intermediate grooves which intermesh with the helically extending lobes and intermediate grooves of said male rotor;

wherein said male rotor has an external radius $R_M$ and a pitch radius $R_{MP}$ defining a pitch circle $C_{MP}$;

wherein each lobe of the male rotor in a predetermined section has a leading lobe flank and a trailing lobe flank which are substantially convex, said predetermined section being perpendicular to an axis $O_M$ of the male rotor and an axis $O_F$ of the female rotor;

wherein each lobe of the female rotor in said predetermined section has a leading lobe flank and a trailing lobe flank which are substantially concave;

wherein each lobe of the male rotor and each lobe of the female rotor has an asymmetric profile in said predetermined section;

wherein at least one predetermined flank of one of the male rotor lobes has a male circular arc segment having a center of curvature $A_{1M}$, $A_{2M}$ and a radius of curvature $R_1$, $R_2$, said center of curvature $A_{1M}$, $A_{2M}$ being on the pitch circle $C_{MP}$, and said radius of curvature $R_1$, $R_2$ deviating from a difference between the external radius $R_M$ of the male rotor and the pitch radius $R_{MP}$ of the male rotor;

wherein at least one predetermined flank of one of the female rotor lobes has a female circular arc segment having a center of curvature $A_{1F}$, $A_{2F}$ and the same radius of curvature $R_1$, $R_2$ as the male circular arc segment;

wherein said female circular arc segment cooperates with said male circular arc segment at a moment of contact therebetween; and wherein an angle $\beta_{F1}$, $\beta_{F2}$ formed in a plane perpendicular to the axis $O_M$ of the male rotor and the axis $O_F$ of the female rotor is greater than zero, said angle $\beta_{F1}$, $\beta_{F2}$ being defined as the angle between: (i) a first line traversing the axis $O_F$ female rotor and the axis $O_M$ of the male rotor, and (ii) a second line traversing the axis $O_F$ of the female rotor and the center of curvature $A_{1F}$, $A_{2F}$ of the female circular arc segment, when said first line traverses an innermost point of a groove between succeeding lobes of the female rotor.

4. A pair of co-operating screw rotors according to claim 3, wherein neither said female circular arc segment nor said male circular arc segment crosses said pitch circle $C_{MP}$.

5. A pair of co-operating screw rotors according to claim 3, wherein said at least one predetermined flank of the male rotor lobe is the leading flank of said male rotor lobe, and the radius of curvature $R_1$ is in a range from 0.2 to 0.9 times the difference in radius between the external radius $R_M$ of the male rotor and the pitch radius $R_{MP}$ of the male rotor.

6. A pair of co-operating screw rotors according to claim 5, wherein said male circular arc segment extends an arc length of 0.2 to 0.8 radians.

7. A pair of co-operating screw rotors according to claim 5, wherein said male circular arc segment extends an arc length of 0.5 radians.

8. A pair of co-operating screw rotors according to claim 3, wherein said at least one predetermined flank of the male rotor lobe is the trailing flank of said male rotor lobe, and the radius of curvature $R_1$ is in a range from 1.1 to 2.0 times the difference in radius between the external radius $R_M$ of the male rotor and the pitch radius $R_{MP}$ of the male rotor.

9. A pair of co-operating screw rotors according to claim 8, wherein said male circular arc segment extends an arc length of 0.1 to 0.4 radians.

10. A pair of co-operating screw rotors according to claim 8, wherein said male circular arc segment extends an arc length of 0.25 radians.

11. A pair of co-operating screw rotors according to claim 3, wherein both the leading lobe flank and the trailing lobe flank of the male rotor lobe include the male circular arc segment, and both the leading lobe flank and the trailing lobe flank of the one of the female rotor lobe include the female circular arc segment.

12. A pair of co-operating screw rotors according to claim 11, wherein said radius of curvature $R_1$ of the male circular arc segment of the leading flank of the male rotor lobe is in a range from 0.2 to 0.9 times the difference in radius between the external radius $R_M$ of the male rotor and the pitch radius $R_{MP}$ of the male rotor, and said radius of curvature $R_2$ of the male circular arc segment of the trailing flank of the male rotor lobe is in a range from 1.1 to 2.0 times the difference in radius between the external radius $R_M$ of the male rotor and the pitch radius $R_{MP}$ of the male rotor.

13. A pair of co-operating screw rotors according to claim 12, wherein a ratio between the radius of curvature $R_2$ of the male circular arc segment of the trailing flank of the male rotor lobe and the radius of curvature $R_1$ of the male circular arc segment of the leading flank of the male rotor lobe is in a range from 1.3 to 5.

14. A pair of co-operating screw rotors according to claim 3, wherein both the leading lobe flank and the trailing lobe flank of the male rotor lobe include the male circular arc segment, and the center of curvature $A_{1M}$ of the male circular arc segment of the leading flank of the male rotor lobe coincides with the center of curvature $A_{2M}$ of the male circular arc segment of the trailing flank of the male rotor lobe.

15. A pair of co-operating screw rotors according to claim 3, wherein both the leading lobe flank and the trailing lobe flank of the male rotor lobe include the male circular arc segment, and the center of curvature $A_{1M}$ of the male circular arc segment of the leading flank of the male rotor lobe is spaced apart from the center of curvature $A_{2M}$ of the male circular arc segment of the trailing flank of the male rotor lobe.

16. A pair of co-operating screw rotors, comprising:

a male rotor having helically extending lobes and intermediate grooves; and a female rotor having helically extending lobes and intermediate grooves which intermesh with the helically extending lobes and intermediate grooves of said male rotor;

wherein said male rotor has an external radius $R_M$ and a pitch radius $R_{MP}$ defining a pitch circle $C_{MP}$;

wherein each lobe of the male rotor in a predetermined section has a leading lobe flank and a trailing lobe flank which are substantially convex, said predetermined section being perpendicular to an axis $O_M$ of the male rotor and an axis $O_F$ of the female rotor;

wherein each lobe of the female rotor in said predetermined section has a leading lobe flank and a trailing lobe flank which are substantially concave;

wherein each lobe of the male rotor and each lobe of the female rotor has an asymmetric profile in said predetermined section;

wherein at least one predetermined flank of one of the male rotor lobes has a male circular arc segment which at least at end portions thereof has a shape of a circular arc having a center of curvature $A_{1M}$, $A_{2M}$ and an equal radius of curvature $R_1$, $R_2$, said center of curvature $A_{1M}$, $A_{2M}$ being on the pitch circle $C_{MP}$, and said radius of curvature $R_1$, $R_2$ deviating from a difference between the external radius $R_M$ of the male rotor and the pitch radius $R_{MP}$ of the male rotor;

wherein at least one predetermined flank of one of the female rotor lobes has a female circular arc segment having a center of curvature $A_{1F}$, $A_{2F}$ and the same radius of curvature $R_1$, $R_2$ as the male circular arc segment;

wherein said female circular arc segment coincides with at least the end portions of said male circular arc segment at a moment of contact between said female circular arc segment and said male circular arc segment; and wherein an angle $\beta_{F1}$, $\beta_{F2}$ formed in a plane perpendicular to the axis $O_M$ of the male rotor and the axis $O_F$ of the female rotor is greater than zero, said angle $\beta_{F1}$, $\beta_{F2}$ being defined as the angle between: (i) a first line traversing the axis $O_F$ female rotor and the axis $O_M$ of the male rotor, and (ii) a second line traversing the axis $O_F$ of the female rotor and the center of curvature $A_{1F}$, $A_{2F}$ of the female circular arc segment, when said first line traverses an innermost point of a groove between succeeding lobes of the female rotor.

17. A pair of co-operating screw rotors according to claim 16, wherein neither said female circular arc segment nor said male circular arc segment crosses said pitch circle $C_{MP}$.

18. A pair of co-operating screw rotors according to claim 16, wherein said at least one predetermined flank of the male rotor lobe is the leading flank of said male rotor lobe, and the radius of curvature $R_1$ is in a range from 0.2 to 0.9 times the difference in radius between the external radius $R_M$ of the male rotor and the pitch radius $R_{MP}$ of the male rotor.

19. A pair of co-operating screw rotors according to claim 18, wherein said male circular arc segment extends an arc length of 0.2 to 0.8 radians.

20. A pair of co-operating screw rotors according to claim 18, wherein said male circular arc segment extends an arc length of 0.5 radians.

21. A pair of co-operating screw rotors according to claim 16, wherein said at least one predetermined flank of the male rotor lobe is the trailing flank of said male rotor lobe, and the radius of curvature $R_1$ is in a range from 1.1 to 2.0 times the difference in radius between the external radius $R_M$ of the male rotor and the pitch radius $R_{MP}$ of the male rotor.

22. A pair of co-operating screw rotors according to claim 21, wherein said male circular arc segment extends an arc length of 0.1 to 0.4 radians.

23. A pair of co-operating screw rotors according to claim 21, wherein said male circular arc segment extends an arc length of 0.25 radians.

24. A pair of co-operating screw rotors according to claim 16, wherein both the leading lobe flank and the trailing lobe flank of the male rotor lobe include the male circular arc segment, and both the leading lobe flank and the trailing lobe flank of the one of the female rotor lobe include the female circular arc segment.

25. A pair of co-operating screw rotors according to claim 24, wherein said radius of curvature $R_1$ of the male circular arc segment of the leading flank of the male rotor lobe is in a range from 0.2 to 0.9 times the difference in radius between the external radius $R_M$ of the male rotor and the pitch radius $R_{MP}$ of the male rotor, and said radius of curvature $R_2$ of the male circular arc segment of the trailing flank of the male rotor lobe is in a range from 1.1 to 2.0 times the difference in radius between the external radius $R_M$ of the male rotor and the pitch radius $R_{MP}$ of the male rotor.

26. A pair of co-operating screw rotors according to claim 25, wherein a ratio between the radius of curvature $R_2$ of the male circular arc segment of the trailing flank of the male rotor lobe and the radius of curvature $R_1$ of the male circular arc segment of the leading flank of the male rotor lobe is in a range from 1.3 to 5.

27. A pair of co-operating screw rotors according to claim 16, wherein both the leading lobe flank and the trailing lobe flank of the male rotor lobe include the male circular arc segment, and the center of curvature $A_{1M}$ of the male circular arc segment of the leading flank of the male rotor lobe coincides with the center of curvature $A_{2M}$ of the male circular arc segment of the trailing flank of the male rotor lobe.

28. A pair of co-operating screw rotors according to claim 16, wherein both the leading lobe flank and the trailing lobe flank of the male rotor lobe include the male circular arc segment, and the center of curvature $A_{1M}$ of the male circular arc segment of the leading flank of the male rotor lobe is spaced apart from the center of curvature $A_{2M}$ of the male circular arc segment of the trailing flank of the male rotor lobe.

* * * * *